US007889167B2

(12) United States Patent
Kim

(10) Patent No.: US 7,889,167 B2
(45) Date of Patent: Feb. 15, 2011

(54) LIQUID CRYSTAL DISPLAY AND DRIVING METHOD THEREOF

(75) Inventor: Jong Tae Kim, Basan (KR)

(73) Assignee: LG Display Co., Ltd., Seoul (KR)

( * ) Notice: Subject to any disclaimer, the term of this patent is extended or adjusted under 35 U.S.C. 154(b) by 896 days.

(21) Appl. No.: 11/819,487

(22) Filed: Jun. 27, 2007

(65) Prior Publication Data

US 2008/0012814 A1 Jan. 17, 2008

(30) Foreign Application Priority Data

Nov. 6, 2006 (KR) ..... 10-2006-0108856

(51) Int. Cl.
*G09G 3/36* (2006.01)

(52) U.S. Cl. ..... 345/96; 345/92; 345/209; 345/89; 345/204

(58) Field of Classification Search ..... 345/92, 345/94–96, 208–210, 204, 89, 690
See application file for complete search history.

(56) References Cited

U.S. PATENT DOCUMENTS 5,438,342 A * 8/1995 Yamaguchi ..... 345/58
2004/0070581 A1* 4/2004 Hiraki et al. ..... 345/209
2004/0196242 A1* 10/2004 Jang et al. ..... 345/94
2004/0239602 A1* 12/2004 Kim et al. ..... 345/87
2005/0219190 A1* 10/2005 Lee et al. ..... 345/96
2008/0170024 A1* 7/2008 Song et al. ..... 345/96

* cited by examiner

*Primary Examiner*—Lun-Yi Lao
(74) *Attorney, Agent, or Firm*—McKenna Long & Aldridge LLP

(57) ABSTRACT

A liquid crystal display for recognizing a flicker with the naked eyes in a step of inspecting a flicker in the case where a liquid crystal display is driven with a frame frequency of 120 Hz is disclosed.

In the liquid crystal display, a timing controller supplies a first frame inversion polarity signal which is used at a first frame inversion and, at the same time supplies a gate start pulse which indicates a supply of a scanning pulse. A frame polarity signal converting means converts a first frame inversion polarity signal into a second frame inversion polarity signal in response to the gate start pulse. And a data driver changes the inputted frame into a second frame inversion in response to the second frame inversion polarity signal.

31 Claims, 10 Drawing Sheets

LIQUID CRYSTAL DISPLAY AND DRIVING METHOD THEREOF

This application claims the benefit of Korean Patent Application No. P2006-108856 filed in Korea on Nov. 6, 2006, which is hereby incorporated by reference.

BACKGROUND OF THE INVENTION

1. Field of the Invention

The present invention relates to a liquid crystal display, and more particularly to a liquid crystal display that is adaptive for recognizing a flicker with the naked eyes in a step of inspecting a flicker in the case where a liquid crystal display is driven with a frame frequency of 120 Hz, and a driving method thereof.

2. Description of the Related Art

Generally, a liquid crystal display controls light transmittance of liquid crystal cells in accordance with video signals to thereby display a picture. An active matrix type of liquid crystal display having a switching device provided for each liquid crystal cell is advantageous for an implementation of moving picture because it permits an active control of the switching device. The switching device used for the active matrix liquid crystal display mainly employs a thin film transistor (hereinafter, referred to as "TFT") as shown in FIG. 1.

Referring to FIG. 1, the liquid crystal display of the active matrix type converts a digital input data into an analog data voltage on the basis of a gamma reference voltage to supply it to a data line DL and, at the same time supply a scanning pulse to a gate line GL, thereby charging a liquid crystal cell Clc.

A gate electrode of the TFT is connected to the gate line GL, a source electrode is connected to the data line DL, and a drain electrode of the TFT is connected to a pixel electrode of the liquid crystal cell Clc and one end electrode of a storage capacitor Cst.

A common electrode of the liquid crystal cell Clc is supplied with a common voltage Vcom.

When the TFT is turned-on, the storage capacitor Cst charges a data voltage applied from the data line DL to constantly maintain a voltage of the liquid crystal cell Clc.

If the gate pulse is applied to the gate line GL, the TFT is turned-on to define a channel between the source electrode and the drain electrode, thereby supplying a voltage on the data line DL to the pixel electrode of the liquid crystal cell Clc. In this case, liquid crystal molecules of the liquid crystal cell Clc are arranged by an electric field between the pixel electrode and the common electrode to modulate an incident light.

A configuration of the related art liquid crystal display including pixels which have such a structure is the same as shown in FIG. 2.

FIG. 2 is a block diagram showing a configuration of a liquid crystal display of the related art.

Referring to FIG. 2, the liquid crystal display of the related art includes a liquid crystal display panel 110, a data driver 120, a gate driver 130, a gamma reference voltage generator 140, a backlight assembly 150, an inverter 160, a common voltage generator 170, a gate driving voltage generator 180, and a timing controller 190. Herein, the data driver 120 supplies a data to the data lines DL1 to DLm of the liquid crystal display panel 110. The gate driver 130 supplies a scanning pulse to the gate lines GL1 to GLn of the liquid crystal display panel 110. The gamma reference voltage generator 140 generates a gamma reference voltage to supply it to the data driver 120. The backlight assembly 150 irradiates a light onto the liquid crystal display panel 110. The inverter 160 applies an AC current voltage and a current to the backlight assembly 150. The common voltage generator 170 generates a common voltage Vcom to supply it to the common electrode of the liquid crystal cell Clc of the liquid crystal display panel 110. The gate driving voltage generator 180 generates a gate high voltage VGH and a gate low voltage VGL to supply them to the gate driver 130. The timing controller 190 controls the data driver 120 and the gate driver 130.

The liquid crystal display panel 110 has a liquid crystal dropped between two glass substrates. On the lower glass substrate of the liquid crystal display panel 110, the data lines DL1 to DLm and the gate lines GL1 to GLn perpendicularly cross each other. Each intersection between the data lines DL1 to DLm and the gate lines GL1 to GLn is provided with the TFT. The TFT supplies a data on the data lines DL1 to DLm to the liquid crystal cell Clc in response to the scanning pulse. The gate electrode of the TFT is connected to the gate lines GL1 to GLn while the source electrode thereof is connected to the data line DL1 to DLm. Further, the drain electrode of the TFT is connected to the pixel electrode of the liquid crystal cell Clc and to the storage capacitor Cst.

The TFT is turned-on in response to the scanning pulse applied, via the gate lines GL1 to GLn, to the gate terminal thereof. Upon turning-on of the TFT, a video data on the data lines DL1 to DLm is supplied to the pixel electrode of the liquid crystal cell Clc.

The data driver 120 supplies a data to the data lines DL1 to DLm in response to a data driving control signal DDC which is supplied from the timing controller 190. Further, the data driver 120 converts digital video data RGB which are supplied from the timing controller 190 into an analog data voltage on the basis of a gamma reference voltage which is supplied from the gamma reference voltage generator 140 to supply it to the data lines DL1 to DLm. Moreover, the data driver 120 changes a frame, which is inputted via the timing controller 190, in response to a 1-frame inversion polarity signal 1FIV_POL which is supplied from the timing controller 190, into a 1-frame inversion at the liquid crystal display panel 110. Herein, the analog data voltage is realized as a gray scale at the liquid crystal cell Clc of the liquid crystal display panel 110.

The gate driver 130 sequentially generates a scanning pulse in response to a gate driving control signal GDC and a gate shift clock GSC which are supplied from the timing controller 190 to supply them to the gate lines GL1 to GLn. In this case, the gate driver 130 determines a high level voltage and a low level voltage of the scanning pulse in accordance with the gate high voltage VGH and the gate low voltage VGL which are supplied from the gate driving voltage generator 180.

The gamma reference voltage generator 140 receives a high-level power voltage VDD to generate a positive gamma reference voltage and a negative gamma reference voltage to output them to the data driver 120.

The backlight assembly 150 is provided at the rear side of the liquid crystal display panel 110, and is radiated by an AC voltage and a current which are supplied from the inverter 160 to irradiate a light onto each pixel of the liquid crystal display panel 110.

The inverter 160 converts a square wave signal generated at the interior thereof into a triangular wave signal, and then compares the triangular wave signal with a direct current power voltage VCC supplied from the system to generate a burst dimming signal proportional to the result. If the burst dimming signal is generated, then a driving integrated circuit IC (not shown) controlling a generation of the AC voltage and a current within the inverter 160 controls a generation of AC voltage and current supplied to the backlight assembly 150 in accordance with the burst dimming signal.

The common voltage generator 170 receives a high-level power voltage VDD to generate a common voltage Vcom, and supplies it to the common electrode of the liquid crystal cell Clc provided at each pixel of the liquid crystal display panel 110.

The gate driving voltage generator 180 is supplied with a high-level power voltage VDD to generate the gate high voltage VGH and the gate low voltage VGL, and supplies them to the gate driver 130. Herein, the gate driving voltage generator 180 generates a gate high voltage VGH more than a threshold voltage of the TFT provided at each pixel of the liquid crystal display panel 110 and a gate low voltage VGL less then the threshold voltage of the TFT. The gate high voltage VGH and the gate low voltage VGL generated in this manner are used for determining a high level voltage and a low level voltage of the scanning pulse generated by the gate driver 130, respectively.

The timing controller 190 supplies digital video data RGB which are supplied from a digital video card (not shown) to the data driver 120. Furthermore, the timing controller 190 generates a data driving control signal DCC and a gate driving control signal GDC using horizontal/vertical synchronization signals H and V in response to a clock signal CLK to supply them to the data driver 120 and the gate driver 130, respectively. Herein, the data driving control signal DDC includes a source shift clock SSC, a source start pulse SSP, a 1-frame inversion polarity signal 1FIV_POL, and a source output enable signal SOE, etc. The gate driving control signal GDC includes a gate start pulse GSP and a gate output enable signal GOE, etc.

Generally, a liquid crystal display 100 having such configurations is driven with a frame frequency of 60 Hz. However, recently, a technique which drives the liquid crystal display 100 with a frame frequency of 120 Hz in order to improve a moving picture stain has been developed.

If the liquid crystal display 100 is driven with a frame frequency of 60 Hz, since a flicker of 30 Hz is generated on a screen as shown in FIG. 3A, the user can recognize a flicker with the naked eyes.

However, if the liquid crystal display 100 is driven with a frame frequency of 120 Hz, since a flicker of 60 Hz is generated on a screen as shown in FIG. 3B, the user cannot recognize a flicker with the naked eyes.

In FIG. 3A and FIG. 3B, an AC voltage is defined such that an amount of light which is irradiated from the front side of a panel is converted into an AC voltage. A DC voltage is defined such that an amount of light which is irradiated from the front side of a panel is converted into a DC voltage.

In general, a process of inspecting and adjusting a flicker which is generated on a screen is carried out in the step of fabricating a liquid crystal display. In this case, the inspector recognizes a flicker with the naked eyes or using inspection equipment in the step of inspecting a flicker. Specially, a flicker of 30 Hz is generated in the case where the liquid crystal display is driven with a frame frequency of 60 Hz. Thus, the inspector recognizes a flicker with the naked eyes and adjusts a flicker. However, a flicker of 60 Hz which is not recognized by the naked eyes is generated in the case where the liquid crystal display of the related art is driven with a frame frequency of 120 Hz. As a result, the inspector should recognize a flicker using separate inspection equipment.

SUMMARY OF THE INVENTION

The present invention is to solve the above-mentioned problem. Accordingly, it is an object of the present invention to provide a liquid crystal display that is adaptive for converting a first frame inversion polarity signal into a second frame inversion polarity signal, and a driving method thereof.

It is another object of the present invention to provide a liquid crystal display that is adaptive for converting a first frame inversion polarity signal into a second frame inversion polarity signal to carry out a second frame inversion driving, and a driving method thereof.

It is still another object of the present invention to provide a liquid crystal display that is adaptive for converting a first frame inversion polarity signal into a second frame inversion polarity signal to recognize a flicker with the naked eyes in a step of inspecting a flicker in the case where a liquid crystal display is driven with a frame frequency of 120 Hz, and a driving method thereof.

It is still another object of the present invention to provide a liquid crystal display that is adaptive for recognizing a flicker with the naked eyes in a step of inspecting a flicker in the case where a liquid crystal display is driven with a frame frequency of 120 Hz to reduce a cost and time that are required for purchasing and using inspection equipment, and a driving method thereof.

In order to achieve these and other objects of the invention, a liquid crystal display according to the present invention comprises a timing controller that supplies a first frame inversion polarity signal which is used at a first frame inversion and, supplies a gate start pulse which indicates a supply of a scanning pulse; a frame polarity signal converting means that converts a first frame inversion polarity signal into a second frame inversion polarity signal in response to the gate start pulse; and a data driver that changes the inputted frame into a second frame inversion in response to the second frame inversion polarity signal.

The frame polarity signal converting means includes a first flip-flop that generates a first period signal and a first inversed period signal in accordance with the gate start pulse; a second flip-flop that generates a second period signal and a second inversed period signal in accordance with the first period signal; and an exclusive OR gate that carries out an exclusive OR operation of the second period signal and the first frame inversion polarity signal to generate the second frame inversion polarity signal.

The first flip-flop includes a clock terminal that receives the gate start pulse, an output terminal that outputs the first period signal, an inversed output terminal that outputs the first inversed period signal, and an input terminal that is connected to the inversed output terminal.

In the liquid crystal display, a high level and a low level of the first period signal and a first inversed period signal are maintained for a period of 120 Hz, respectively.

The second flip-flop includes a clock terminal that receives the first period signal, an output terminal that outputs the second period signal, an inversed output terminal that outputs the second inversed period signal, and an input terminal that is connected to the inversed output terminal.

In the liquid crystal display, a high level and a low level of the second period signal and a second inversed period signal are maintained for a period of 60 Hz, respectively.

In the liquid crystal display, the first frame inversion polarity signal is a 1 frame inversion polarity signal which is used at a 1-frame inversion.

In the liquid crystal display, the second frame inversion polarity signal is a 2 frame inversion polarity signal that indicates a 2-frame inversion.

In the liquid crystal display, the second frame output terminal that outputs the first period signal, an inversed output terminal that outputs the first inversed period signal, and an input terminal that is connected to the inversed output terminal.

A high level and a low level of the first period signal and a first inversed period signal are maintained for a period of 120 Hz, respectively.

The second signal generating means is a flip-flop having a clock terminal that receives the first period signal, an output terminal that outputs the second period signal, an inversed output terminal that outputs the second inversed period signal, and an input terminal that is connected to the inversed output terminal.

A high level and a low level of the second period signal and a second inversed period signal are maintained for a period of 60 Hz, respectively.

The third signal generating means is an exclusive OR gate that carries out an exclusive OR logic operation of the second period signal and the first frame inversion polarity signal to generate the second frame inversion inversion polarity signal is a 4 frame inversion polarity signal that indicates a 4-frame inversion.

In the liquid crystal display, the second frame inversion polarity signal is an N frame inversion polarity signal that indicates an N-frame inversion.

In the liquid crystal display, the second frame inversion polarity signal is a Z frame inversion polarity signal that indicates a Z-frame inversion.

A liquid crystal display according to the present invention comprises a first signal generating means that generates a first period signal and a first inversed period signal in accordance with a gate start pulse; a second signal generating means that generates a second period signal and a second inversed period signal in accordance with the first period signal; and a third signal generating means that generates a second frame inversion polarity signal using the second period signal and the first frame inversion polarity signal.

The first signal generating means is a flip-flop having a clock terminal that receives the gate start pulse, an polarity signal.

In the liquid crystal display, the first frame inversion polarity signal is a 1 frame inversion polarity signal which is used at a 1-frame inversion.

In the liquid crystal display, the second frame polarity signal is a 2 frame inversion polarity signal that indicates a 2-frame inversion.

In the liquid crystal display, the second frame inversion polarity signal is a 4 frame inversion polarity signal that indicates a 4-frame inversion.

In the liquid crystal display, the second frame inversion polarity signal is an N frame inversion polarity signal that indicates an N-frame inversion. Wherein N is integer and is greater than 1.

In the liquid crystal display, the second frame inversion polarity signal is a Z frame inversion polarity signal that indicates a Z-frame inversion. Wherein Z is integer and is greater than 2.

A method of driving a liquid crystal display according to the present invention comprises generating a first frame inversion polarity signal which is used at a first frame inversion and a gate start pulse that indicates a supply of a scanning pulse; converting the first frame inversion polarity signal into a second frame inversion polarity signal in response to the gate start pulse; and changing the inputted frame to a second frame inversion in response to the second frame inversion polarity signal.

The step of converting the first frame inversion polarity signal into a second frame inversion polarity signal includes generating a first period signal and a first inversed period signal in accordance with the gate start pulse; generating a second period signal and a second inversed period signal in accordance with the first period signal; and carrying out an exclusive OR logic operation of the second period signal and the first frame inversion polarity signal to generate the second frame inversion polarity signal.

In the method, a high level and a low level of the first period signal and a first inversed period signal are maintained for a period of 120 Hz, respectively.

In the method, a high level and a low level of the second period signal and a second inversed period signal are maintained for a period of 60 Hz, respectively.

In the method, the first frame inversion polarity signal is a 1 frame inversion polarity signal which is used at a 1-frame inversion.

In the method, the second frame inversion polarity signal is a 2 frame inversion polarity signal that indicates a 2-frame inversion.

In the method, the second frame inversion polarity signal is a 4 frame inversion polarity signal that indicates a 4-frame inversion.

In the method, the second frame inversion polarity signal is an N frame inversion polarity signal that indicates an N-frame inversion.

In the method, the second frame inversion polarity signal is a Z frame inversion polarity signal that indicates a Z-frame inversion.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to the accompanying drawings.

Figure 1:
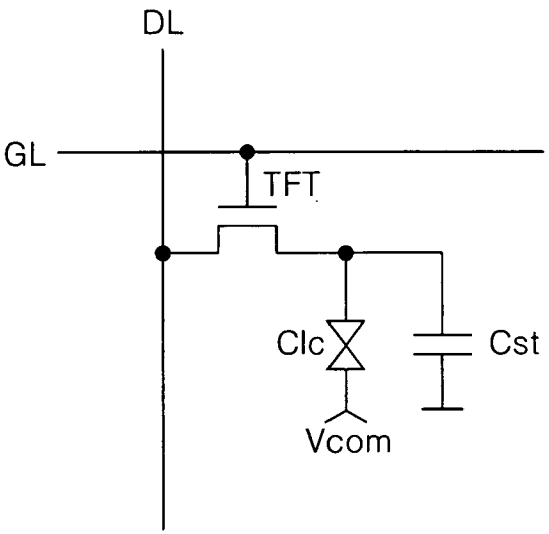
FIG. 1 RELATED ART
FIG. 1 is an equivalent circuit diagram showing a pixel provided at a liquid crystal display of a related art.
Figure 2:
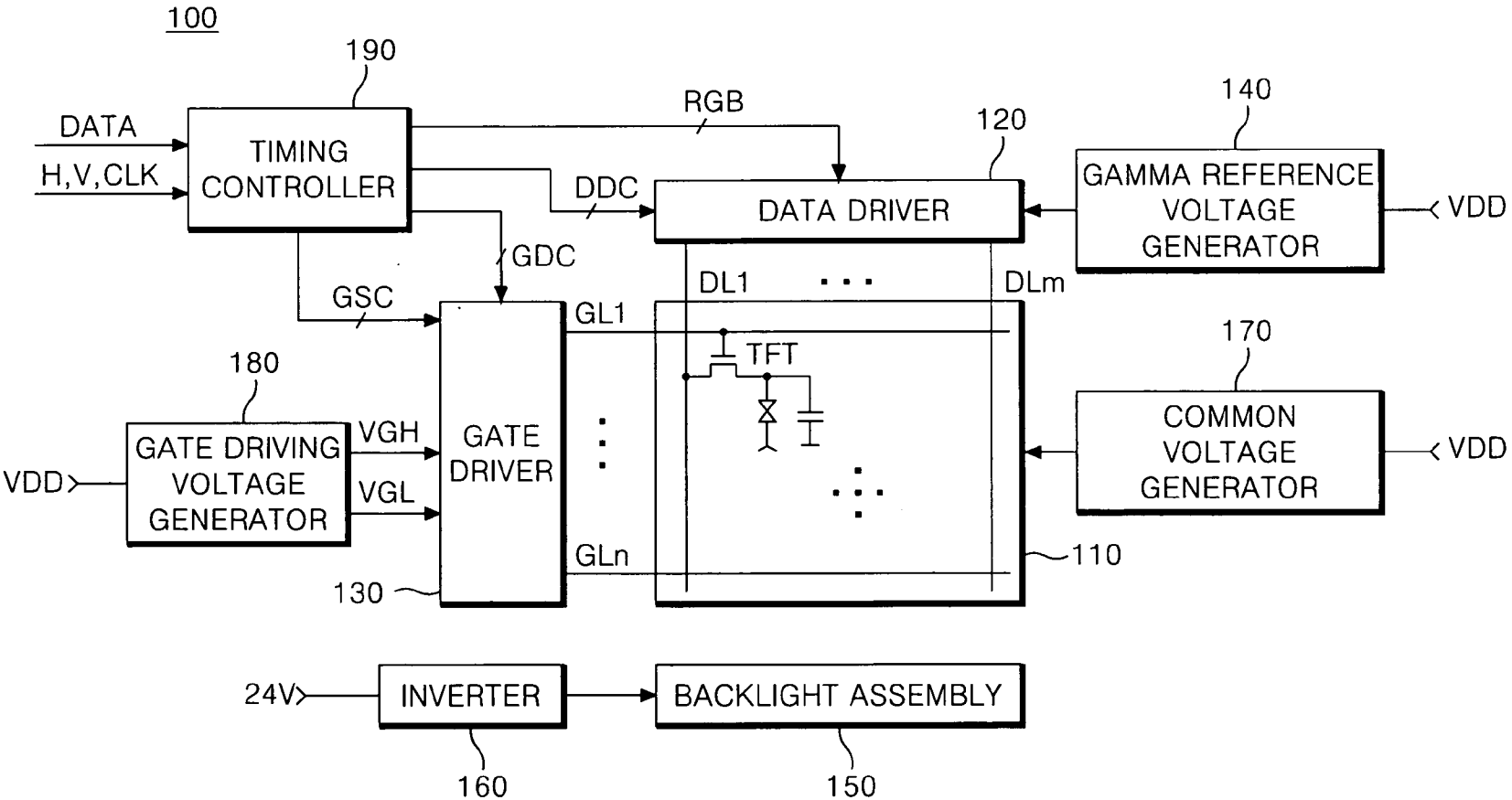
FIG.2 RELATED ART
FIG. 2 is a block diagram showing a configuration of the liquid crystal display of related art.
Figure 4:
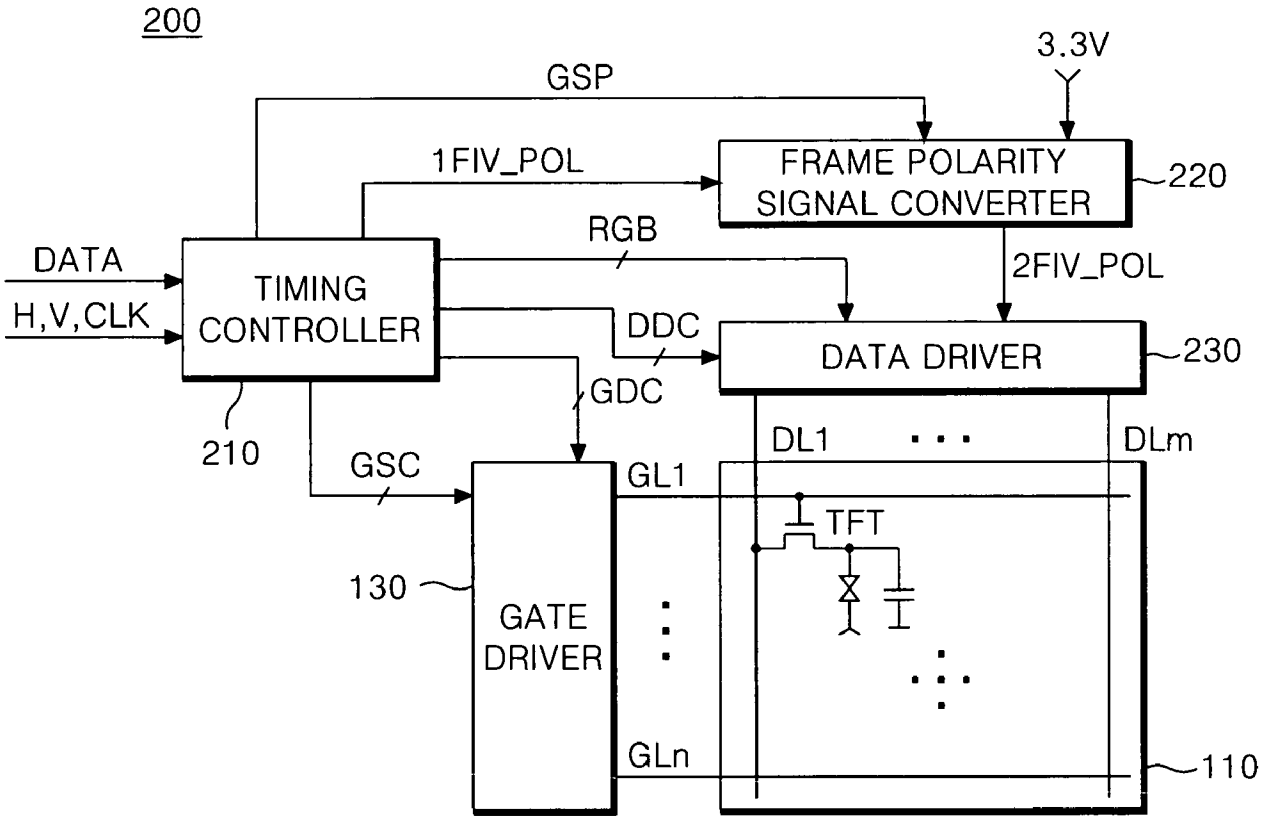
FIG. 4 is a block diagram showing a configuration of a liquid crystal display according to an embodiment of the present invention.

FIG. 4 is a block diagram showing a configuration of a liquid crystal display according to an embodiment of the present invention. Herein, a liquid crystal display 200 of the present invention includes the gamma reference voltage generator 140, the backlight assembly 150, the inverter 160, the common voltage generator 170, and the gate driving voltage generator 180 similar to the liquid crystal display 100 in FIG. 2. However, for the sake of explanation, such configurations will be omitted in FIG. 4.

Referring to FIG. 4, the liquid crystal display 200 of the present invention includes the liquid crystal display panel 110, the gate driver 130, a timing controller 210, a frame polarity signal converter 220, and a data driver 230. Herein, the timing controller 210 supplies a 1 frame inversion polarity signal 1FIV_POL which is used for a 1-frame inversion and, at the same time supplies a gate start pulse GSP that indicates a supply of a scanning pulse. The frame polarity signal converter 220 converts a 1 frame inversion polarity signal 1FIV_POL from the timing controller 210 into a 2 frame inversion polarity signal 2FIV_POL in response to a gate start pulse GSP from the timing controller 210. The data driver 230 changes a frame, which is supplied from the timing controller 210, into a 2-frame inversion at the liquid crystal display panel 110 in response to a 2 frame inversion polarity signal 2FIV_POL, which is converted by the frame polarity signal converter 220.

The timing controller 210 supplies digital video data RGB which are supplied from a system to the data driver 120. Furthermore, the timing controller 210 generates a data driving control signal DCC and a gate driving control signal GDC using horizontal/vertical synchronization signals H and V in response to a clock signal CLK from a system to supply them to the data driver 230 and the gate driver 130, respectively. Herein, the data driving control signal DDC includes a source shift clock SSC, a source start pulse SSP, and a source output enable signal SOE, etc. The gate driving control signal GDC includes a gate start pulse GSP and a gate output enable signal GOE, etc.

The timing controller 210 supplies a 1 frame inversion polarity signal 1FIV_POL that indicates an inversion driving of a frame to the frame polarity signal converter 220, and supplies a gate start pulse GSP which is used for converting a 1 frame inversion polarity signal 1FIV_POL to the frame polarity signal converter 220.

The frame polarity signal converter 220 generates a first period signal PS1 in accordance with a gate start pulse GSP from the timing controller 210, and then generates a second period signal PS2 in accordance with the first period signal PS1. Furthermore, the frame polarity signal converter 220 carries out an exclusive OR logic operation of the generated second period signal PS2 and a 1 frame inversion polarity signal 1FIV_POL from the timing controller 210 to generate a 2 frame inversion polarity signal 2FIV_POL. In this case, the frame polarity signal converter 220 supplies a 2 frame inversion polarity signal 2FIV_POL to the data driver 230.

The data driver 230 supplies a data to the data lines DL1 to DLm in response to a data driving control signal DDC supplied from the timing controller 210. The data driver 230 converts digital video data RGB which are supplied from the timing controller 210 into an analog data voltage on the basis of a gamma reference voltage to supply it to the data lines DL1 to DLm. Furthermore, the data driver 230 is a frame, which is inputted via the timing controller 210, into a 2-frame inversion at the liquid crystal display panel 110 in response to a 2 frame inversion polarity signal 2FIV_POL, which is supplied from the frame polarity signal converter 220. Herein, the analog data voltage is realized as a gray scale at the liquid crystal cell Clc of the liquid crystal display panel 110.

Figure 3A:
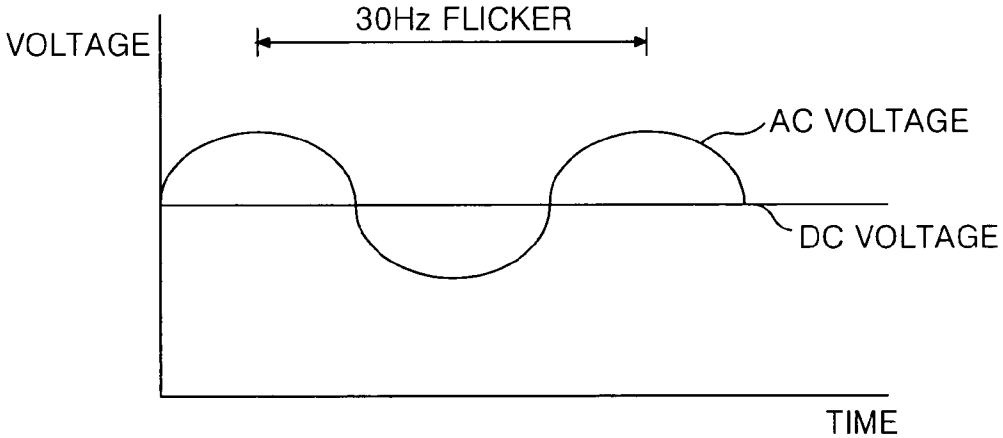
FIG.3A RELATED ART
FIG. 3A is a diagram showing a characteristics of a flicker which is generated at a liquid crystal display driven with a frame frequency of 60 Hz.
Figure 3B:
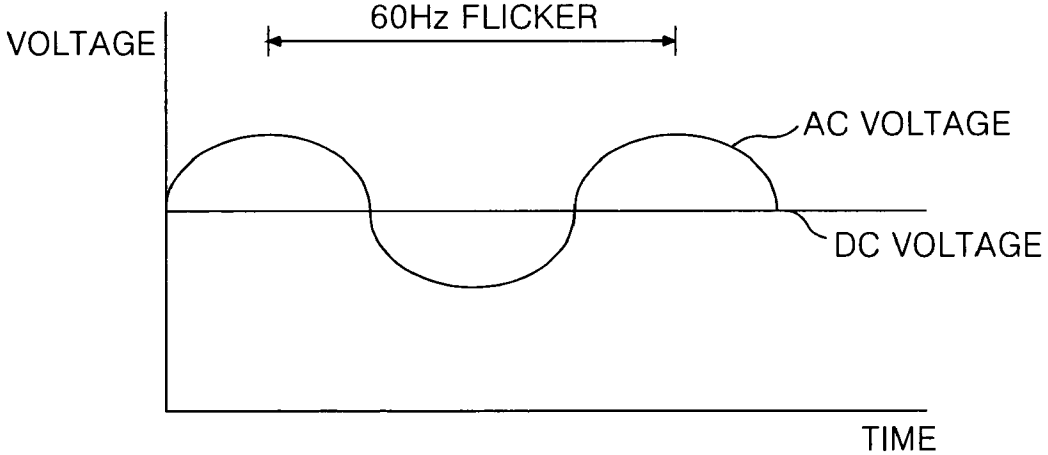
FIG.3B RELATED ART
FIG. 3B is a diagram showing a characteristics of a flicker which is generated at a liquid crystal display driven with a frame frequency of 120 Hz.
Figure 5:
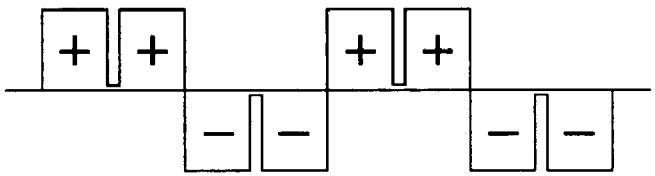
FIG. 5 is a diagram showing an example of a characteristics of a 2-frame inversion of the liquid crystal display according to the embodiment of the present invention.

In this way, if the liquid crystal display 200 is driven with a 2-frame inversion, a polarity is inversed in a 2 frames unit as shown in FIG. 5. Thus, a flicker of 60 Hz which is generated at the liquid crystal display 200 driven with a frame frequency of 120 Hz is converted into a flicker of 30 Hz in FIG. 3A. Accordingly, the inspector recognizes a flicker of 30 Hz which is generated on the liquid crystal display 220 driven with a frame frequency of 120 Hz with the naked eyes to adjust a flicker in the step of inspecting a flicker.

On the other hand, since a technique of the present invention that converts a 1-frame inversion driving into a 2-frame inversion driving is used at a process of fabricating a product, the frame polarity signal converter 220 is turned-on/off by an on/off switches thereof (not shown). In other words, in the step of inspecting and adjusting a flicker, the user operates the on/off switches to turn-on the frame polarity signal converter 220, thereby allowing a 2 frame inversion polarity signal 2FIV_POL which is converted by the frame polarity signal converter 220 to be supplied to the data driver 230. On the contrary, if the viewer uses the completed product, the frame polarity signal converter 220 is maintained as an off-state to allow a 1 frame inversion polarity signal 1FIV_POL which is generated by the timing controller 210 to be supplied to the data driver 230.

Figure 6:
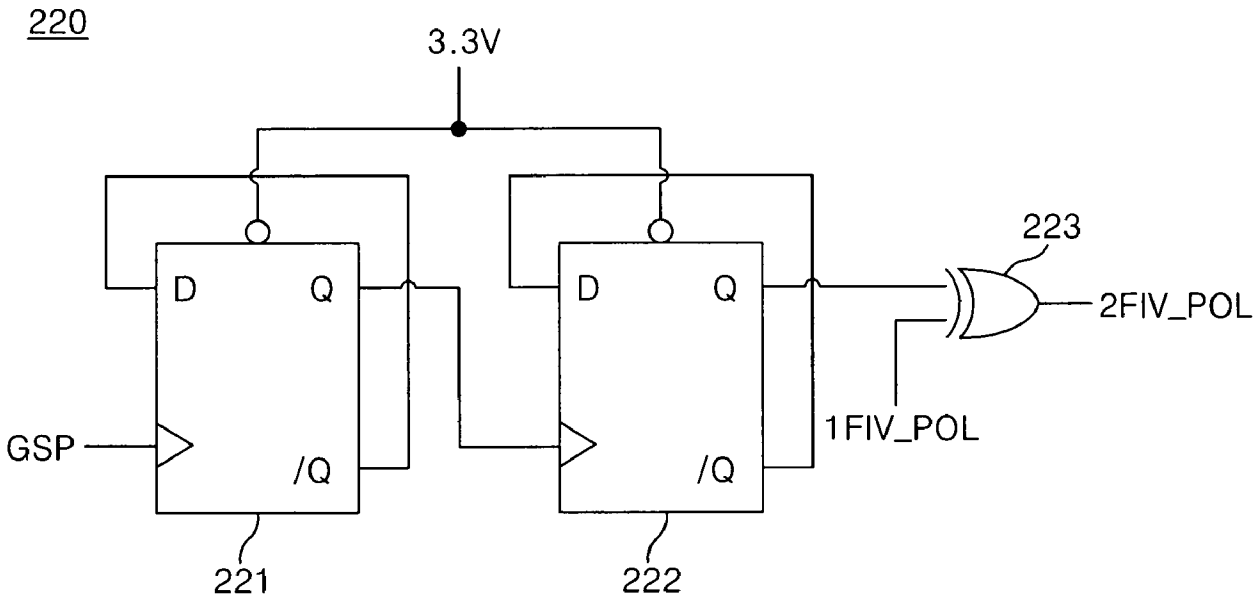
FIG. 6 is a circuit diagram of the frame polarity signal converter in FIG. 4.

FIG. 6 is a circuit diagram of the frame polarity signal converter in FIG. 4.

Referring to FIG. 6, the frame polarity signal converter 220 includes a first flip-flop 221, a second flip-flop 222, and an exclusive OR gate XOR GATE 223. Herein, the first flip-flop 221 generates a first period signal PS1 in accordance with a gate start pulse GSP from the timing controller 210. The second flip-flop 222 generates a second period signal PS2 in accordance with a first period signal PS1 of the first flip-flop 221. The exclusive OR gate 223 carries out an exclusive OR logic operation of a second period signal PS2 which is generated by the second flip-flop 222 and a 1 frame inversion polarity signal 1FIV_POL from the timing controller 210 to generate a 2 frame inversion polarity signal 2FIV_POL.

The first flip-flop 221 includes a clock terminal that receives the gate start pulse GSP, an output terminal Q that outputs a first period signal PS1, an inversed output terminal /Q that outputs a first inversed period signal /PS1, and an input terminal D that is connected to the inversed output terminal /Q. Herein, a function of the first flip-flop 221 will be described with reference to FIG. 7 as follows.

Figure 7:
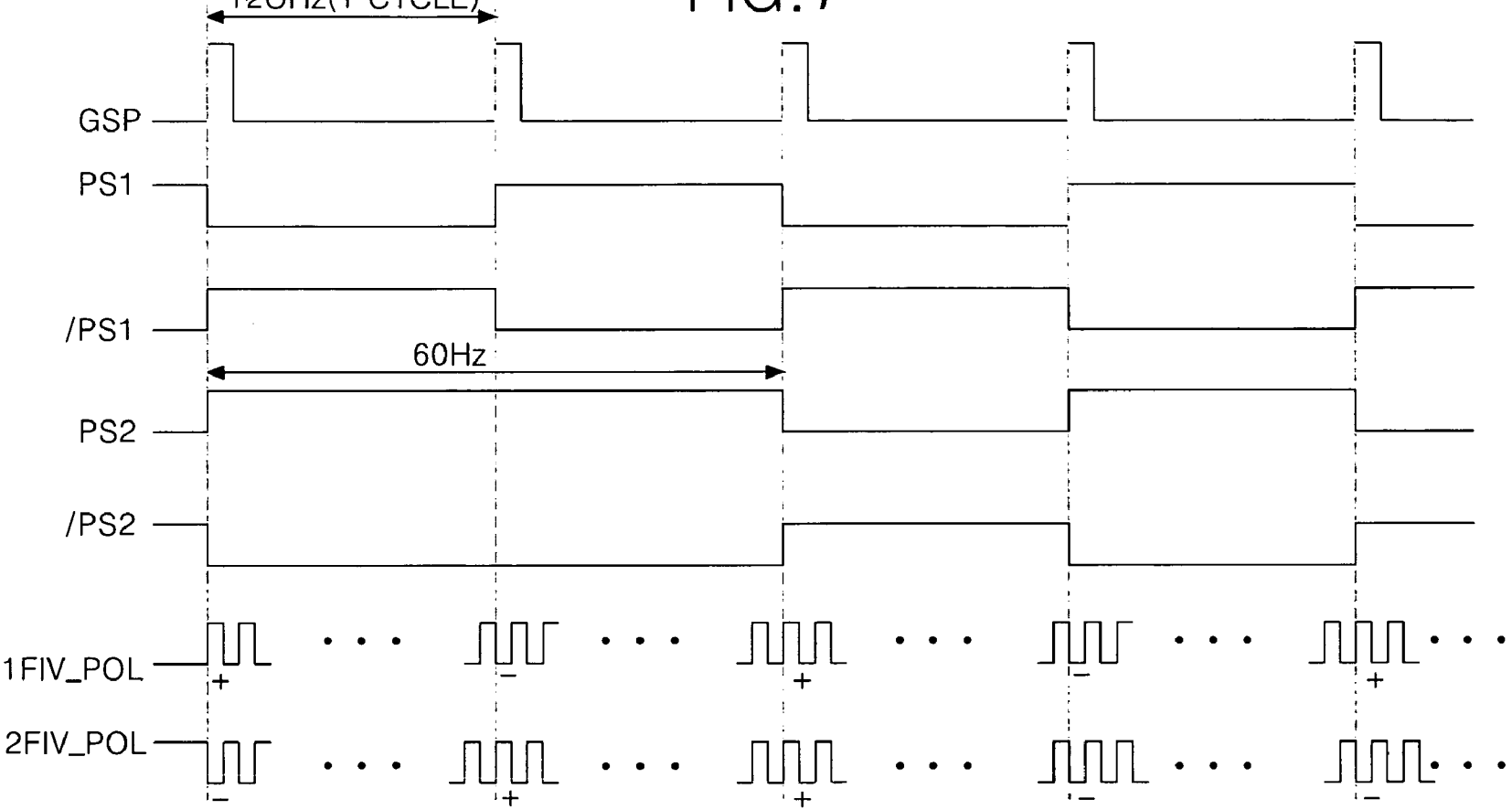
FIG. 7 is a diagram showing a characteristics of a signal of the liquid crystal display according to the embodiment of the present invention.

Referring to FIG. 7, if a gate start pulse GSP having a period of 120 Hz is inputted to a clock terminal of the first flip-flop 221, the first flip-flop 221 outputs a first period signal PS1 of low level via an output terminal Q and, at the same time outputs a first inversed period signal /PS1 of high level via an inversed output terminal /Q for a 1 period of a gate start pulse GSP. Sequentially, the first flip-flop 221 outputs a first period signal PS1 of high level via an output terminal Q and, at the same time outputs a first inversed period signal /PS1 of low level via an inversed output terminal /Q for the next 1 period. The first flip-flop 221 outputs a first period signal PS1 and a first inversed period signal /PS1 of which a high level and a low level are alternatively changed whenever a period of a gate start pulse GSP is changed through a series of process of generating a signal.

Herein, a first period signal PS1 which is outputted via an output terminal Q of the first flip-flop 221 is inputted to a clock terminal of the second flip-flop 222. A first inversed period signal /PS1 which is outputted via an inversed output terminal /Q of the first flip-flop 221 is inputted to an input terminal D of the first flip-flop 221. Furthermore, a high level and a low level of a first period signal PS1 and a first inversed period signal /PS1 are maintained for a period of 120 Hz, and then are converted into another level, respectively.

The second flip-flop 222 includes a clock terminal that receives a first period signal PS1, an output terminal Q that outputs a second period signal PS2, an inversed output terminal /Q that outputs a second inversed period signal /PS2, and an input terminal D that is connected to an inversed output terminal /Q. Herein, a function of the first flip-flop 222 will be described with reference to FIG. 7 as follows.

Referring to FIG. 7, if a first period signal PS1 which is maintained as a high level or a low level for a period of 120 Hz is inputted to a clock terminal of the second flip-flop 222, the second flip-flop 222 outputs a second period signal PS2 of high level via an output terminal Q and, at the same time outputs a second inversed period signal /PS2 of low level via an inversed output terminal /Q during a low level and a high level of a first period signal PS1 is sequentially inputted. Next, the second flip-flop 222 outputs a second period signal PS2 of low level via an output terminal Q and, at the same time outputs a second inversed period signal /PS2 of high level via an inversed output terminal /Q for a low level interval and a high level interval of the next first period signal PS1. The first flip-flop 222 outputs a second period signal PS2 and a second inversed period signal /PS2 of which a high level and a low level are alternatively changed whenever a sequential low level and a sequential high level of a first period signal PS1 are changed through a series of process of generating a signal.

Herein, a second period signal PS2 which is outputted via an output terminal Q of the second flip-flop 222 is inputted to an input terminal of the exclusive OR gate 223. A second inversed period signal /PS2 which is outputted via an inversed output terminal /Q of the second flip-flop 222 is inputted to an input terminal D of the second flip-flop 222. Furthermore, a high level and a low level of a second period signal PS2 and a second inversed period signal /PS2 are maintained for a period of 60 Hz, and then are converted into another level, respectively.

The exclusive OR gate 223 includes a first input terminal which is connected to an output terminal Q of the second flip-flop 222, a second input terminal which is connected to an output terminal of a 1 frame inversion polarity signal 1FIV_POL of the timing controller 210, and an output terminal which is connected to the data driver 230. Herein, a function of the exclusive OR gate 223 will be described with reference to FIG. 7 as follows.

Referring to FIG. 7, the exclusive OR gate 223 carries out an exclusive OR logic operation of a second period signal PS2 which is inputted from the second flip-flop 222 and a 1 frame inversion polarity signal 1FIV_POL from the timing controller 210 to generate a 2 frame inversion polarity signal 2FIV_POL. More specifically, if a high level of a second period signal PS2 and a 1 frame inversion polarity signal 1FIV_POL of positive polarity, or a low level of a second period signal PS2 and a 1 frame inversion polarity signal 1FIV_POL of negative polarity is simultaneously inputted, the exclusive OR gate 223 outputs a 2 frame inversion polarity signal 2FIV_POL of negative polarity via an output terminal. On the contrary, if a low level of a second period signal PS2 and a 1 frame inversion polarity signal 1FIV_POL of positive polarity, or a high level of a second period signal PS2 and a 1 frame inversion polarity signal 1FIV_POL of negative polarity is simultaneously inputted, the exclusive OR gate 223 outputs a 2 frame inversion polarity signal 2FIV_POL of positive polarity via an output terminal. Furthermore, if a high level of a second period signal PS2 and a 1 frame inversion polarity signal 1FIV_POL of negative polarity, or a low level of a second period signal PS2 and a 1 frame inversion polarity signal 1FIV_POL of positive polarity is simultaneously inputted, the exclusive OR gate 223 outputs a 2 frame inversion polarity signal 2FIV_POL of positive polarity via an output terminal.

A 1 frame inversion polarity signal 1FIV_POL is alternatively converted at a rising edge that each period of a gate start pulse GSP is started owing to an operating characteristics of the exclusive OR gate 223. On the contrary, a 2 frame inversion polarity signal 2FIV_POL which is outputted from the exclusive OR gate 223 is continuously twice maintained as a positive polarity or a negative polarity, and then a polarity thereof is inversed at a rising edge that each period of a gate start pulse GSP is started. In other words, the exclusive OR gate 223 continuously twice outputs a 2 frame inversion polarity signal 2FIV_POL of positive polarity, and then continuously twice outputs a 2 frame inversion polarity signal 2FIV_POL of negative polarity on the basis of a rising edge part of each period of a gate start pulse GSP. Accordingly, the data driver 230 changes a frame, which is inputted from the timing controller 210, into a 2-frame inversion at the liquid crystal display panel 110 in response to a 2 frame inversion polarity signal 2FIV_POL from the exclusive OR gate 223 as shown in FIG. 5.

Figure 8:
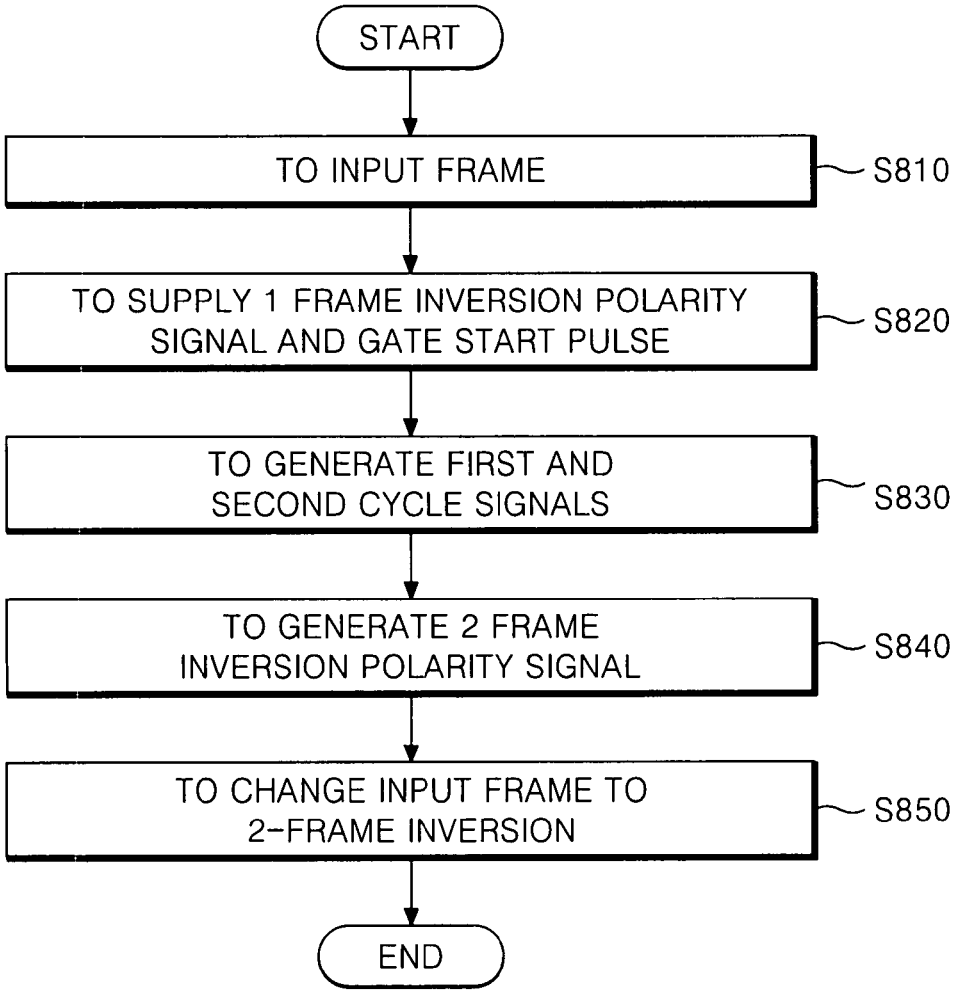
FIG. 8 is a flow chart showing a method of driving the liquid crystal display according to the embodiment of the present invention.

FIG. 8 is a flow chart showing a method of driving the liquid crystal display according to the embodiment of the present invention.

Referring to FIG. 8, if a frame is inputted from a system (S810), the timing controller 210 supplies a 1 frame inversion polarity signal 1FIV_POL that indicates an inversion driving of a frame to the frame polarity signal converter 220 and, at the same time supplies a gate start pulse GSP which is used for converting a 1 frame inversion polarity signal 1FIV_POL to the frame polarity signal converter 220 (S820).

Next, the frame polarity signal converter 220 generates a first period signal PS1 in accordance with a gate start pulse GSP from the timing controller 210, and then generates a second period signal PS2 in accordance with the first period signal PS1 (S830). Furthermore, the frame polarity signal converter 220 carries out an exclusive OR logic operation of the generated second period signal PS2 and a 1 frame inversion polarity signal 1FIV_POL from the timing controller 210 to generate a 2 frame inversion polarity signal 2FIV_POL, thereby supplying it to the data driver 230 (S840).

The data driver 230 changes a frame, which is inputted via the timing controller 210, into a 2-frame inversion to realize it at the liquid crystal display panel 110 in response to a 2 frame inversion polarity signal 2FIV_POL (S850).

Figure 9:
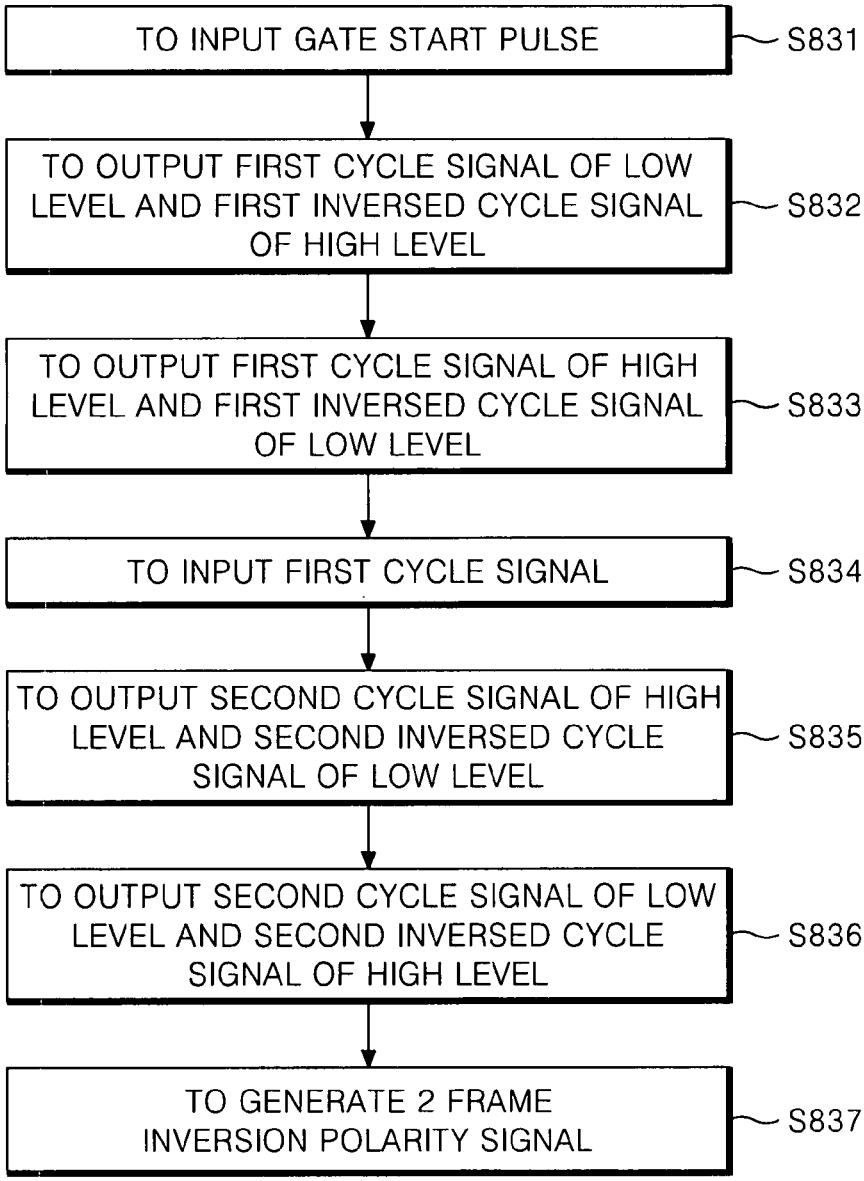
FIG. 9 is a flow chart showing in detail a step of generating the period signal and the 2 frame inversion polarity signal in FIG. 8.

FIG. 9 is a flow chart showing in detail a step of generating the period signal and the 2 frame inversion polarity signal in FIG. 8.

Referring to FIG. 9, if a gate start pulse GSP having a period of 120 Hz is inputted to a clock terminal of the first flip-flop 221 (S831), the first flip-flop 221 outputs a first period signal PS1 of low level via an output terminal Q and, at the same time outputs a first inversed period signal /PS1 of high level via an inversed output terminal /Q for a 1 period of a gate start pulse GSP (S832). Sequentially, the first flip-flop 221 outputs a first period signal PS1 of high level via an output terminal Q and, at the same time outputs a first inversed period signal /PS1 of low level via an inversed output terminal /Q for the next 1 period (S833). In this case, a first period signal PS1 which is outputted via an output terminal Q of the first flip-flop 221 is inputted to a clock terminal of the second flip-flop 222, and a first inversed period signal /PS1 which is outputted via an inversed output terminal /Q of the first flip-flop 221 is inputted to an input terminal D of the first flip-flop 221. Furthermore, a high level and a low level of a first period signal PS1 and a first inversed period signal /PS1 are maintained for a period of 120 Hz, and then are converted into another level, respectively.

If a first period signal PS1 which is maintained as a high level and a low level for a period of 120 Hz is inputted to a clock terminal of the second flip-flop 222 (S834), the second flip-flop 222 outputs a second period signal PS2 of high level via an output terminal Q and, at the same time outputs a second inversed period signal /PS2 of low level via an inversed output terminal /Q during a low level and a high level of a first period signal PS1 is sequentially inputted (S835). Next, the second flip-flop 222 outputs a second period signal PS2 of low level via an output terminal Q and, at the same time outputs a second inversed period signal /PS2 of high level via an inversed output terminal /Q for a low level interval and a high level interval of the next first period signal PS1 (S836). In this case, a second period signal PS2 which is outputted via an output terminal Q of the second flip-flop 222 is inputted to an input terminal of the exclusive OR gate 223. A second inversed period signal /PS2 which is outputted via an inversed output terminal /Q of the second flip-flop 222 is inputted to an input terminal D of the second flip-flop 222. Furthermore, a high level and a low level of a second period signal PS2 and a second inversed period signal /PS2 are maintained for a period of 60 Hz, and then are converted into another level, respectively.

Next, the exclusive OR gate 223 carries out an exclusive OR logic operation of a second period signal PS2 which is inputted from the second flip-flop 222 and a 1 frame inversion polarity signal 1FIV_POL which is inputted from the timing controller 210 to generate a 2 frame inversion polarity signal 2FIV_POL (S837). In this case, if a high level of a second period signal PS2 and a 1 frame inversion polarity signal 1FIV_POL of positive polarity, or a low level of a second period signal PS2 and a 1 frame inversion polarity signal 1FIV_POL of negative polarity is simultaneously inputted, the exclusive OR gate 223 outputs a 2 frame inversion polarity signal 2FIV_POL of negative polarity via an output terminal. On the contrary, if a low level of a second period signal PS2 and a 1 frame inversion polarity signal 1FIV_POL of positive polarity, or a high level of a second period signal PS2 and a 1 frame inversion polarity signal 1FIV_POL of negative polarity is simultaneously inputted, the exclusive OR gate 223 outputs a 2 frame inversion polarity signal 2FIV_POL of positive polarity via an output terminal. Furthermore, if a high level of a second period signal PS2 and a 1 frame inversion polarity signal 1FIV_POL of negative polarity, or a low level of a second period signal PS2 and a 1 frame inversion polarity signal 1FIV_POL of positive polarity is simultaneously inputted, the exclusive OR gate 223 outputs a 2 frame inversion polarity signal 2FIV_POL of positive polarity via an output terminal.

As described above, the present invention is only an example of a case that the liquid crystal display is driven by a 2-frame inversion method. Furthermore, the spirit of the present invention is not limited to this.

For example, if the spirit of the present invention is applied to a liquid crystal display which is driven by a 4-frame inversion method, the exclusive OR gate 223 is realized to generate a 4 frame inversion polarity signal that indicates a 4-frame inversion. In this case, another signal instead of a 1 frame inversion polarity signal 1FIV_POL may be used for generating a 4 frame inversion polarity signal.

For example, if the spirit of the present invention is applied to a liquid crystal display which is driven by an N-frame inversion method, the exclusive OR gate 223 is realized to generate an N frame inversion polarity signal that indicates an N-frame inversion. In this case, another signal instead of a 1 frame inversion polarity signal 1FIV_POL may be used for generating an N frame inversion polarity signal.

For example, if the spirit of the present invention is applied to a liquid crystal display which is driven by a Z-frame inversion method, the exclusive OR gate 223 is realized to generate a Z frame inversion polarity signal that indicates a Z-frame inversion. In this case, another signal instead of a 1 frame inversion polarity signal 1FIV_POL may be used for generating a Z frame inversion polarity signal.

As described above, the present invention converts a first frame inversion polarity signal into a second frame inversion polarity signal to carry out a second frame inversion driving. Thus, the present invention converts a flicker of 60 Hz which is generated when a liquid crystal display is driven with a frame frequency of 120 Hz into a flicker of 30 Hz. As a result, the present invention recognizes a flicker with the naked eyes in a step of inspecting a flicker in the case where a liquid crystal display is driven with a frame frequency of 120 Hz to reduce a cost and time that are required for purchasing and using inspection equipment.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display, comprising:

a timing controller that supplies a first frame inversion polarity signal which is used at a first frame inversion and, supplies a gate start pulse which indicates a supply of a scanning pulse;

a frame polarity signal converting means that converts a first frame inversion polarity signal into a second frame inversion polarity signal in response to the gate start pulse; and a data driver that changes the inputted frame into a second frame inversion in response to the second frame inversion polarity signal.

2. The liquid crystal display according to claim 1, wherein the frame polarity signal converting means includes:

a first flip-flop that generates a first period signal and a first inversed period signal in accordance with the gate start pulse;

a second flip-flop that generates a second period signal and a second inversed period signal in accordance with the first period signal; and an exclusive OR gate that carries out an exclusive OR logic operation of the second period signal and the first frame inversion polarity signal to generate the second frame inversion polarity signal.

3. The liquid crystal display according to claim 2, wherein the first flip-flop includes a clock terminal that receives the gate start pulse, an output terminal that outputs the first period signal, an inversed output terminal that outputs the first inversed period signal, and an input terminal that is connected to the inversed output terminal.

4. The liquid crystal display according to claim 3, wherein a high level and a low level of the first period signal are maintained for a period of 120 Hz, respectively, and wherein a high level and a low level of the a first inversed period signal are maintained for a period of 120 Hz, respectively.

5. The liquid crystal display according to claim 2, wherein the second flip-flop includes a clock terminal that receives the first period signal, an output terminal that outputs the second period signal, an inversed output terminal that outputs the second inversed period signal, and an input terminal that is connected to the inversed output terminal.

6. The liquid crystal display according to claim 5, wherein a high level of the second period signal is maintained for a period of 60 Hz and a low level of the second inversed period signal is maintained for a period of 60 Hz.

7. The liquid crystal display according to claim 2, wherein the first frame inversion polarity signal is a 1 frame inversion polarity signal which is used at a 1-frame inversion.

8. The liquid crystal display according to claim 2, wherein the second frame inversion polarity signal is a 2 frame inversion polarity signal that indicates a 2-frame inversion.

9. The liquid crystal display according to claim 2, wherein the second frame inversion polarity signal is a 4 frame inversion polarity signal that indicates a 4-frame inversion.

10. The liquid crystal display according to claim 2, wherein the second frame inversion polarity signal is an N frame inversion polarity signal that indicates a N-frame inversion, wherein N is an integer which is greater than 1.

11. The liquid crystal display according to claim 2, wherein the second frame inversion polarity signal is a Z frame inversion polarity signal that indicates a Z-frame inversion, wherein Z is an integer which is greater than 2.

12. A liquid crystal display, comprising:

a first signal generating means that generates a first period signal and a first inversed period signal in accordance with a gate start pulse;

a second signal generating means that generates a second period signal and a second inversed period signal in accordance with the first period signal; and a third signal generating means that generates a second frame inversion polarity signal using the second period signal and the first frame inversion polarity signal.

13. The liquid crystal display according to claim 12, wherein the second signal generating means is a flip-flop having a clock terminal that receives the first period signal, an output terminal that outputs the second period signal, an inversed output terminal that outputs the second inversed period signal, and an input terminal that is connected to the inversed output terminal.

14. The liquid crystal display according to claim 13, wherein a high level of the second period signal is maintained for a period of 60 Hz and a low level of the second inversed period signal is maintained for a period of 60 Hz.

15. The liquid crystal display according to claim 12, wherein the first signal generating means is a flip-flop having a clock terminal that receives the gate start pulse, an output terminal that outputs the first period signal, an inversed output terminal that outputs the first inversed period signal, and an input terminal that is connected to the inversed output terminal.

16. The liquid crystal display according to claim 15, wherein a high level and a low level of the first period signal are maintained for a period of 120 Hz, respectively, and wherein a high level and a low level of the a first inversed period signal are maintained for a period of 120 Hz, respectively.

17. The liquid crystal display according to claim 15, wherein the third signal generating means is an exclusive OR gate that carries out an exclusive OR logic operation of the second period signal and the first frame inversion polarity signal to generate the second frame inversion polarity signal.

18. The liquid crystal display according to claim 17, wherein the first frame inversion polarity signal is a 1 frame inversion polarity signal which is used at a 1-frame inversion.

19. The liquid crystal display according to claim 17, wherein the second frame inversion polarity signal is a 2 frame inversion polarity signal that indicates a 2-frame inversion.

20. The liquid crystal display according to claim 17, wherein the second frame inversion polarity signal is a 4 frame inversion polarity signal that indicates a 4-frame inversion.

21. The liquid crystal display according to claim 17, wherein the second frame inversion polarity signal is an N frame inversion polarity signal that indicates a N-frame inversion, wherein N is an integer which is greater than 1.

22. The liquid crystal display according to claim 17, wherein the second frame inversion polarity signal is a Z frame inversion polarity signal that indicates a Z-frame inversion, wherein Z is an integer which is greater than 2.

23. A method of driving a liquid crystal display, comprising:

generating a 1 frame inversion polarity signal which is used at a 1 frame inversion and a gate start pulse that indicates a supply of a scanning pulse;

converting the 1 frame inversion polarity signal into a second frame inversion polarity signal in response to the gate start pulse; and changing the inputted frame to a second frame inversion in response to the 2 frame inversion polarity signal.

24. The method of driving the liquid crystal display according to claim 23, wherein a high level and a low level of the first period signal are maintained for a period of 120 Hz, respectively, and wherein a high level and a low level of the a first inversed period signal are maintained for a period of 120 Hz, respectively.

25. The method of driving the liquid crystal display according to claim 23, wherein a high level of the second period signal is maintained for a period of 60 Hz and a low level of the second inversed period signal is maintained for a period of 60 Hz.

26. The method of driving the liquid crystal display according to claim 23, wherein the step of converting the 1 frame inversion polarity signal into the second frame inversion polarity signal includes:

generating a first period signal and a first inversed period signal in accordance with the gate start pulse;

generating a second period signal and a second inversed period signal in accordance with the first period signal; and carrying out an exclusive OR logic operation of the second period signal and the first frame inversion polarity signal to generate the second frame inversion polarity signal.

27. The method of driving the liquid crystal display according to claim 26, wherein the first frame inversion polarity signal is a 1 frame inversion polarity signal which is used at a 1-frame inversion.

28. The method of driving the liquid crystal display according to claim 26, wherein the second frame inversion polarity signal is a 2 frame inversion polarity signal that indicates a 2-frame inversion.

29. The method of driving the liquid crystal display according to claim 26, wherein the second frame inversion polarity signal is a 4 frame inversion polarity signal that indicates a 4-frame inversion.

30. The method of driving the liquid crystal display according to claim 26, wherein the second frame inversion polarity signal is an N frame inversion polarity signal that indicates a N-frame inversion, wherein N is an integer which is greater than 1.

31. The method of driving the liquid crystal display according to claim 26, wherein the second frame inversion polarity signal is a Z frame inversion polarity signal that indicates a Z-frame inversion, wherein Z is an integer which is greater than 2.

* * * * *